US006364113B1

(12) United States Patent
Faasse, Jr. et al.

(10) Patent No.: US 6,364,113 B1
(45) Date of Patent: Apr. 2, 2002

(54) RESEALABLE CONTAINER

(75) Inventors: Adrian L. Faasse, Jr., Carmel Valley, CA (US); Glen E. Groeneweg, Lowell, MI (US); Charles E. Piette, Kentwood, MI (US); Michael G. Marcoux, Wyoming, MI (US)

(73) Assignee: Corium Corporation, Grand Rapids, MI (US)

( * ) Notice: Subject to any disclaimer, the term of this patent is extended or adjusted under 35 U.S.C. 154(b) by 0 days.

(21) Appl. No.: 09/686,261

(22) Filed: Oct. 11, 2000

(51) Int. Cl.[7] ..... B65D 73/00

(52) U.S. Cl. ..... 206/469; 206/484; 206/807; 206/459.1

(58) Field of Search ..... 206/469, 484, 206/484.2, 807, 349, 532, 538, 363, 459.1

(56) References Cited

U.S. PATENT DOCUMENTS

| | | | | | |
|---|---|---|---|---|---|
| 3,389,827 | A | | 6/1968 | Abere et al. | |
| 4,200,193 | A | * | 4/1980 | Boyle | 206/461 |
| 4,482,053 | A | * | 11/1984 | Alpern et al. | 206/439 |
| 4,511,035 | A | * | 4/1985 | Alpern | 206/363 |
| 4,537,312 | A | * | 8/1985 | Intini | 206/531 |
| 4,574,954 | A | * | 3/1986 | Reid | 206/531 |
| 4,803,048 | A | * | 2/1989 | Nason | 206/569 |
| 4,804,377 | A | | 2/1989 | Hanifl et al. | |
| 4,946,038 | A | * | 8/1990 | Eaton | 206/528 |
| 5,002,197 | A | | 3/1991 | Ponsi | |
| 5,219,356 | A | | 6/1993 | Harreld et al. | |
| 5,388,699 | A | | 2/1995 | Ratajczak et al. | |
| 5,538,129 | A | * | 7/1996 | Chester et al. | 206/63.5 |
| 5,591,468 | A | * | 1/1997 | Stockley, III et al. | 46/106 |
| 5,686,126 | A | * | 11/1997 | Noel et al. | 206/484 |
| 5,725,311 | A | | 3/1998 | Ponsi et al. | |
| 5,785,180 | A | * | 7/1998 | Dressel et al. | 206/532 |
| 5,833,928 | A | | 11/1998 | Ratajczak et al. | |
| 5,868,253 | A | * | 2/1999 | Krueger et al. | 206/438 |

* cited by examiner

*Primary Examiner*—Shian Luong
(74) *Attorney, Agent, or Firm*—Price, Heneveld, Cooper, DeWitt & Litton

(57) ABSTRACT

A resealable tamper evident container including a first material with a first adhesive at least about a portion of the perimeter of the first material where the first material is at least partially perforated about the perimeter of the first material. The container further includes a second material with a second adhesive at least about a portion of the perimeter of the second material where the first material is engaged with the second material such that at least a portion of the first adhesive remains exposed. The container also includes a tray with a cavity and a flange extending about at least a portion of the perimeter of the tray where the tray is releasably engaged to the second material by at least a portion of the second adhesive.

30 Claims, 5 Drawing Sheets

RESEALABLE CONTAINER

BACKGROUND OF THE INVENTION

The invention relates in part to point of purchase display packaging and in part to resealable containers for any number or kinds of items.

Point of purchase display packaging often consists of a display card with merchandise either shrink-wrapped against the card, or contained in a clear plastic vacuum-formed container, which is adhered to a card by adhesive. In either case the seal between the card and the clear plastic wrap or container is destroyed when the container is first opened.

In one variation on such packaging, the card itself is perforated behind the plastic container. The package is opened by breaking open the card along the perforations. The seal is thus also permanently broken when the card is opened along the perforations.

At one time, hardware product was sold in a container with a cover adhered to the container by a resealable adhesive, such that the container could be opened to remove some product, but resealed to contain the balance of the product. However, the container opened in the store such that product spilled out.

U.S. Pat. No. 3,389,827 to Abere et al. discloses an easy opening container sealed with pressure sensitive sealing tape. U.S. Pat. No. 5,725,311 to Ponsi et al. provides a resealable package for cloths, wherein an adhesive layer tab is removed and replaced providing access to the contents of the container.

SUMMARY OF THE INVENTION

In one aspect, the present invention is a package with a tamper evident resealable adhesive cover, and to a resealable container with a double adhesive seal, one which is releasably resealable, and one which is more permanent such that product contained in the container cannot accidentally spill out of the container prematurely. The cover is adhered to at least a portion of the surface of the container adjacent the perimeter of the container opening by a releasable resealable adhesive, and includes a tamper indicator, which extends beyond the opening perimeter surface, and is separable from the rest of the cover. The tamper indicator is adhered to a substrate, which also extends beyond the opening perimeter surface, by an adhesive, which is permanent rather than releasable and resealable. Thus, the cover has to be separated from the tamper indicator in order to first open the container. This affords visual evidence that the cover has been opened a first time, even after it is resealed to the container, and also provides a second seal against accidental opening.

In one aspect of the invention, the substrate to which the tamper indicator is adhered is an extension of the container surface. In another aspect of the invention, however, it is a separate member, which traps a flange on the container between the cover and the substrate. When the cover is opened, the tamper indicator and the substrate are then separable from the resealable container.

In another aspect, the invention comprises a resealable container, preferably a display pack, with an easy to manufacture resealable adhesive cover. The underside of the cover can be completely covered with said releasable, resealable adhesive, but that portion of the cover which overlies the container opening can itself be substantially covered by a layer of material, which prevents the contents of the container from contacting the releasable, resealable adhesive.

The use of the covering layer eliminates the need to apply adhesive to only a portion of the cover undersurface in order to keep the container contents from being exposed to the adhesive.

Thus the present invention comprises a package which is user friendly, easy to open and easy to reseal. These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
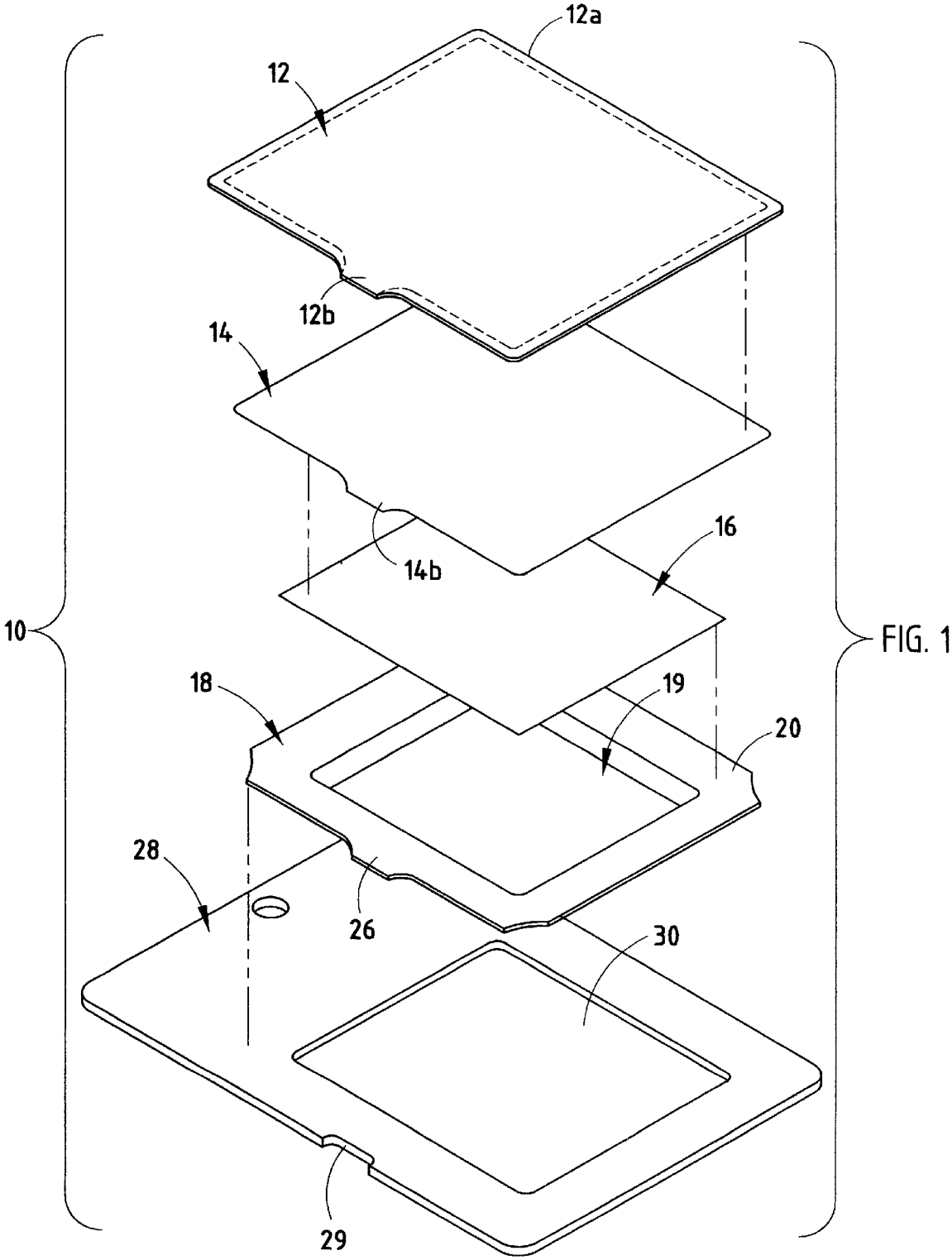
FIG. 1 is an exploded back perspective view of one embodiment of the resealable tamper evident container.

In one preferred embodiment of the invention, the resealable tamper evident package 10 includes a cover 12, which is releasably and resealably adhered to the surface of the perimeter flange 20 of container 18 (FIG. 1). Perimeter flange 20 extends around the perimeter of the opening into the cavity 19 of container 18. Cover 12 includes a perimeter portion 12*a*, which serves as the tamper indicator for the resealable package. Tamper indicator 12*a* is adhered to substrate 28, which can function as a display card for the package, such that flange 20 is trapped between cover 12 and display card substrate member 28.

Cover 12 is preferably a film of flexible material, such as a coated paper or relatively thin cardboard, or a plastic material. Preferably, cover 12 is made of a coated paper.

Figure 2:
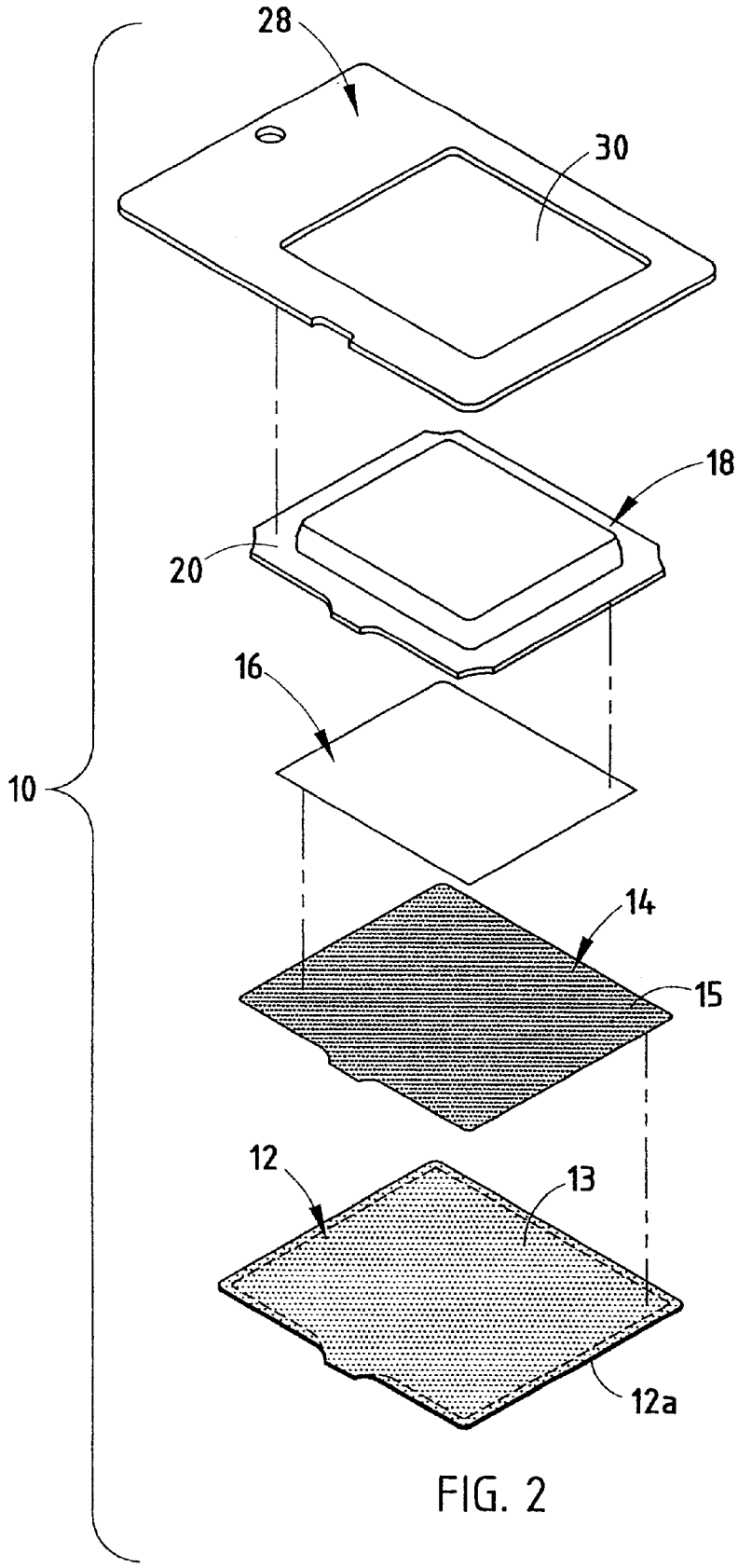
FIG. 2 is an exploded front perspective view of the embodiment of FIG. 1.

In the embodiment of the invention shown in FIGS. 1 and 2, the entire undersurface of cover 12, including its tamper indicating perimeter portion 12, is coated with a permanent adhesive layer 13. The specific adhesive used will be selected as a function of the materials, which it must adhere. It must adhere permanently, as distinguished from releasably and resealably, to the material of cover 12 and display card substrate 28. For the material used in the preferred embodiment, adhesive 13 is preferably a general-purpose hot melt adhesive with high initial tack and excellent ultimate adhesion. The adhesive should demonstrate good resistance to water, ultraviolet light, solvents, and deplasticizers.

In the embodiment of FIGS. 1 and 2, cover 12 comprises additional layers of material 14 and 16. Layer 14 is a flexible film material, which can be of any of the materials described for cover 12. Preferably, layer 14 is coated paper. Its undersurface is entirely coated with an adhesive layer 15, except under tab portion 14*b*. The absence of adhesive under 14*b* provides a composite tab 12*b*–14*b* which facilitate opening the cover. Adhesive 15 must be selected so that it is releasably, resealably adhered to the surface of perimeter flange 20, but will be permanently adhered to the material of film layer 14. Since container 18 is preferably vacuum-formed of a plastic material, preferably polyvinylchloride (PVC), and since layer 14 preferably comprises coated paper, we have found that an ultra removable acrylic adhesive is a suitable adhesive. It is designed to be easily removable from a wide variety of surfaces, excluding high surface energy substrates. It has a peel adhesion (TLMI method) of less than 0.3 lbs./in. (53 N/m), an application temperature from about 40° F. to about 110° F., a service temperature from about −20° F. to above 155° F.

Layer 14 is configured so that it covers the entire adhesive coated surface of cover 12, except for the tamper indicating perimeter portion 12 thereof. Adhesive layer 13 permanently adheres film layer 14 to cover 12. Layer 14 includes a tab 14*b* which underlies and is permanently adhered to tab 12*b* of layer 12.

Adhesive coated layer 14 is itself partially covered by a third, covering film layer 16, which can be of any of the materials described for cover 12. Film 16 is made of a plastic, such as PVC, in the preferred embodiment. Its dimensions are such that it is generally coextensive with the opening into the cavity 19 of container 18. When applied to the adhesive layer 15 on film layer 14, it covers the central portion of adhesive layer 15, but leaves the perimeter portion exposed. It is the exposed perimeter portion of releasable, resealable adhesive layer 15, which releasably and resealably adheres to the upper surface of flange 20 on container 18.

Substrate display card 28 is made of typical display card material. Cardboard is used in the preferred embodiment. Substrate display card 28 includes an opening 30 through which the cavity portion 19 of package 18. Flange 20 of container 18 extends beyond the perimeter of opening 30 in display card 28, such that it seats against the surface of display card 28. The dimensions of container flange 20, relative to the dimensions of cover 12, including tamper-indicating perimeter 12*a,* are such that tamper-indicating portion 12*a* of cover 12 extends beyond the perimeter of container flange 20. When cover 12, including its adhered layers 14 and 16, is assembled with package 18 and display card 28, protective layer 16 prevents any material contained within the cavity 19 of package 18 from coming into contact with the releasable, resealable adhesive layer 15 on intermediate film layer 14. The perimeter portion of intermediate film layer 14 is releasably and resealably adhered to flange 20 of container 18, while the tamper indicating portion 12 of cover 12 extends beyond the perimeter of flange 20 and engages and is adhered to the surface of display card 28. Container flange 20 is thus trapped between cover 12 and display card 28, and is held in place against display card 28 by the adherence of the tamper indicating perimeter portion 12 of cover 12 to display card 28.

Tamper indicating perimeter portion 12 of cover 12 is separable from the remainder of cover 12, preferably by the provision of a perforation line between tamper indicating perimeter portion 12 and the remainder of cover 12. The perforation extends all the way around cover layer 12, spaced slightly inwardly from its perimeter, except that the perforation terminates on either side of tab 12*b*. This facilitates lifting the cover at tab 12*b*–14*b,* and separating the cover from the permanently adhered perimeter portion 12*a*. Cover 12 preferably includes a tab portion 12, which overlies a notch 29 in cover 28. When one wishes to open container 18, one engages tab 12 with one's thumb, and peels cover 12 away from container 18. Because adhesive layer 13 is permanently adhered to display card 28, while adhesive layer 15 is releasably, resealably adhered to container flange 20, the lifting or peeling of cover 12 away from container flange 20 causes the tamper indicating perimeter portion 12 of cover 12 to break away from the remainder of cover 12. As a result, a user has a visible indication that container 18 has been opened. Further, container 18 is then separable from card 28, and thereafter serves as an independent resealable container.

Figure 7:
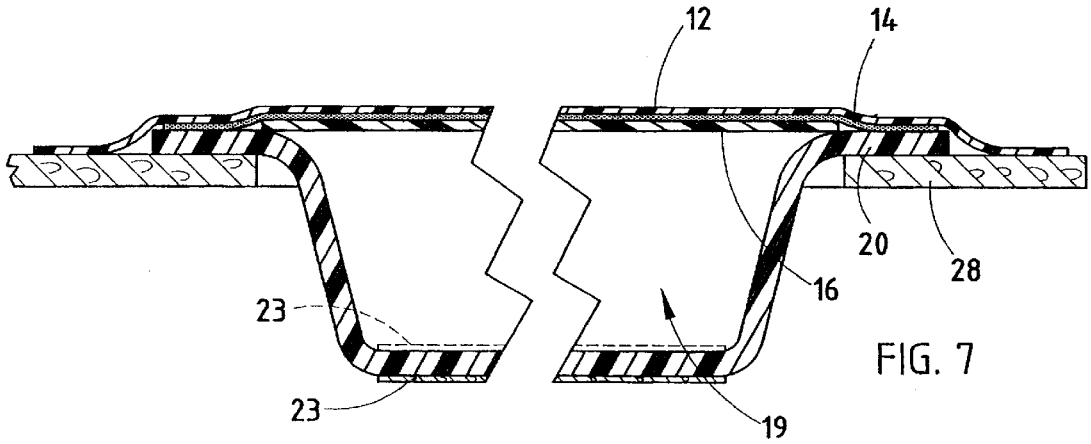
FIG. 7 is a cross-sectional view of the resealable tamper evident container taken along line VII—VII of FIG. 4.

With reference to FIG. 7, whether or not advertising or another design is placed on protective layer 16, a visual display article 23, preferably a display card, may be spaced within the cavity 19. Optionally, the visual display article may be adhered to either the inner surface or the outer surface of the cavity 19. The visual display article may contain advertising or similar material. The visual display article is not necessary and, in some instances may be preferably omitted so that the product contained within the tray may be viewed and examined by a purchaser.

Figure 3:
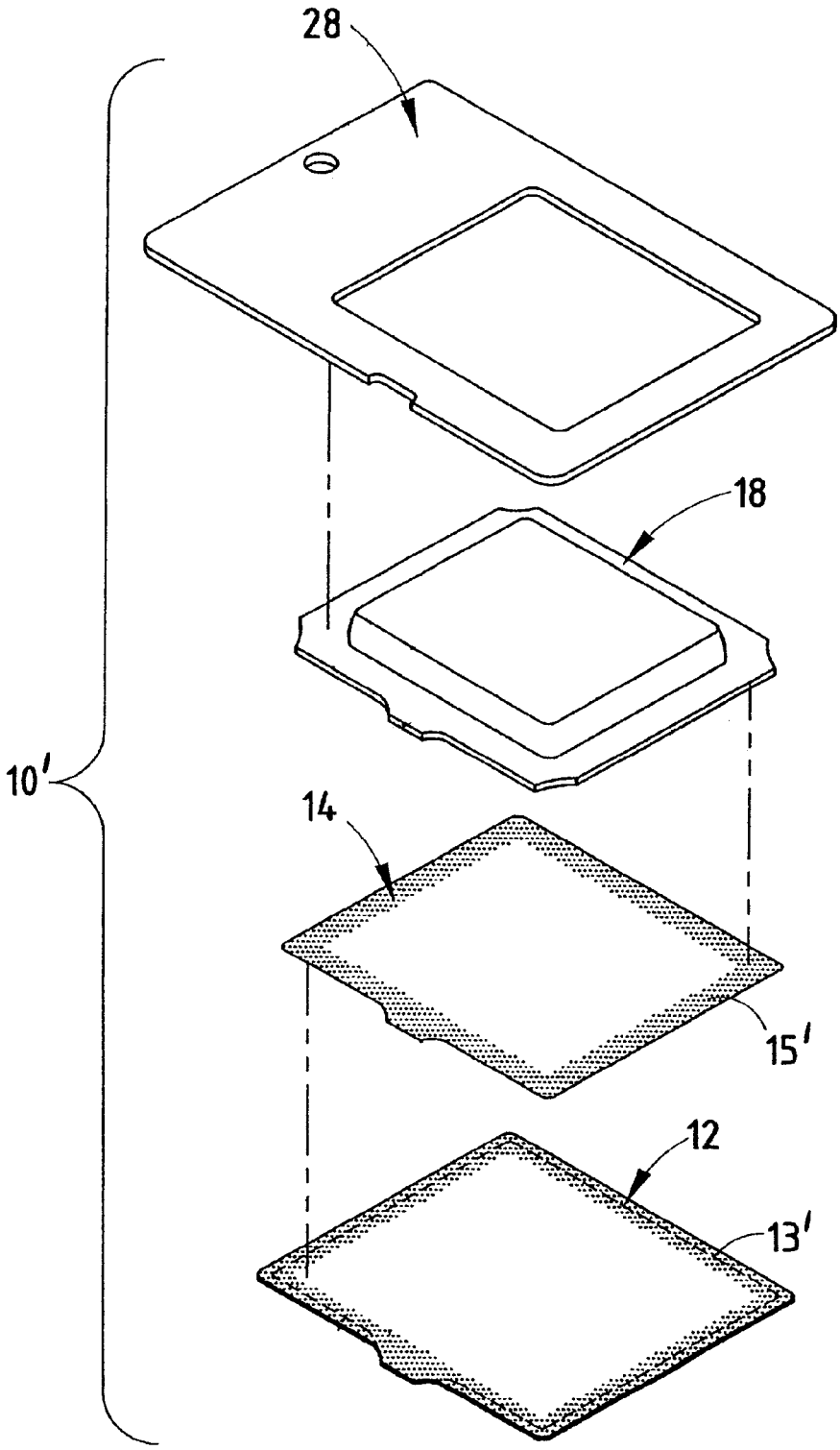
FIG. 3 is an exploded front perspective view of another embodiment of the present invention.

Another embodiment of the invention is shown in FIG. 3 using identical reference numerals for identical elements and prime numerals for elements that are slightly varied. In this embodiment, adhesive 13' is about the perimeter of the undersurface of cover 12. It does extend inwardly from the perimeter of cover 12 such that layer 14 is adhered by adhesive 13' to cover 12. Likewise, the undersurface of layer 14 is coated with adhesive layer 15' about the perimeter of its undersurface. Applying adhesive 15' in this pattern obviates the need to use protective layer 16 to prevent material contained within the cavity 19 of package 10 from coming into contact with adhesive. There is no adhesive to come into contact with in the central portion of layer 14.

Figure 4:
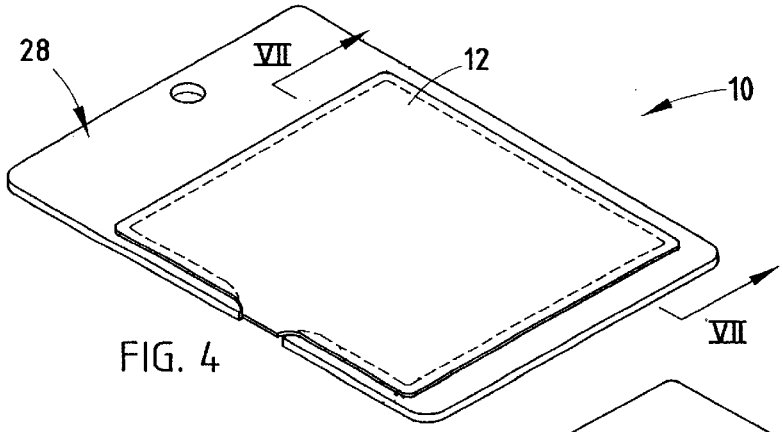
FIGS. 4–6 demonstrate the process of opening and use of the resealable tamper evident container.
Figure 5:
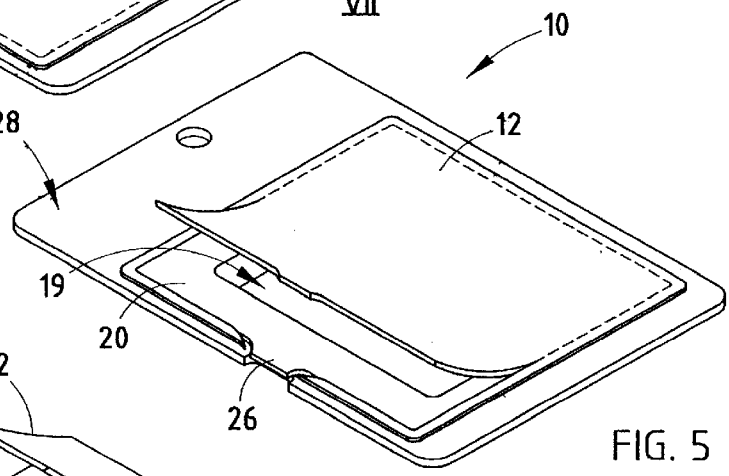
Figure 6:
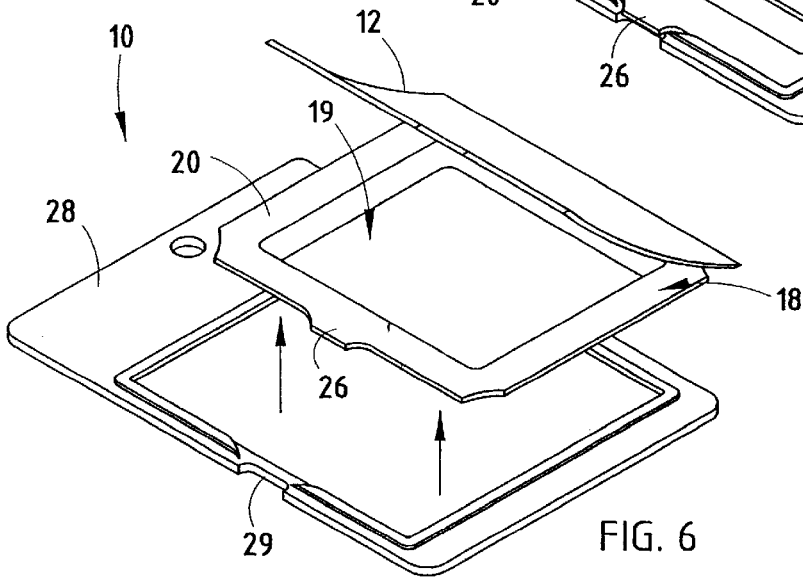

Once a purchaser has purchased the product or products contained in the resealable tamper evident package 10, to open the package (see FIGS. 4–6), the purchaser merely grasps the pull tab 26 of the flange 20 and pulls the container, protective layer and adhered layers 14 and 16 away from the backing. In doing so, the perforation along the perimeter of the layer 14 is broken demonstrating that the product has been opened. If the purchaser notices that the perforation has previously been broken, this demonstrates that the product inside may have been removed or otherwise tampered with. Once removed from the substrate, the substrate may be discarded and the container, protective layer and adhered layers 14 and 16 to allow the purchaser to repeatably access the contents of the tray. The releasable, resealable adhesive and/or the releasable, resealable adhesive and the permanent adhesive operate to allow the user to repeatably open the cover 12, access the contents of the container, and re-adhere the cover to the flange of the container. When a visual display article is used, the visual display article may also function to describe the contents of the tray to the purchaser after the substrate has been discarded.

Figure 8:
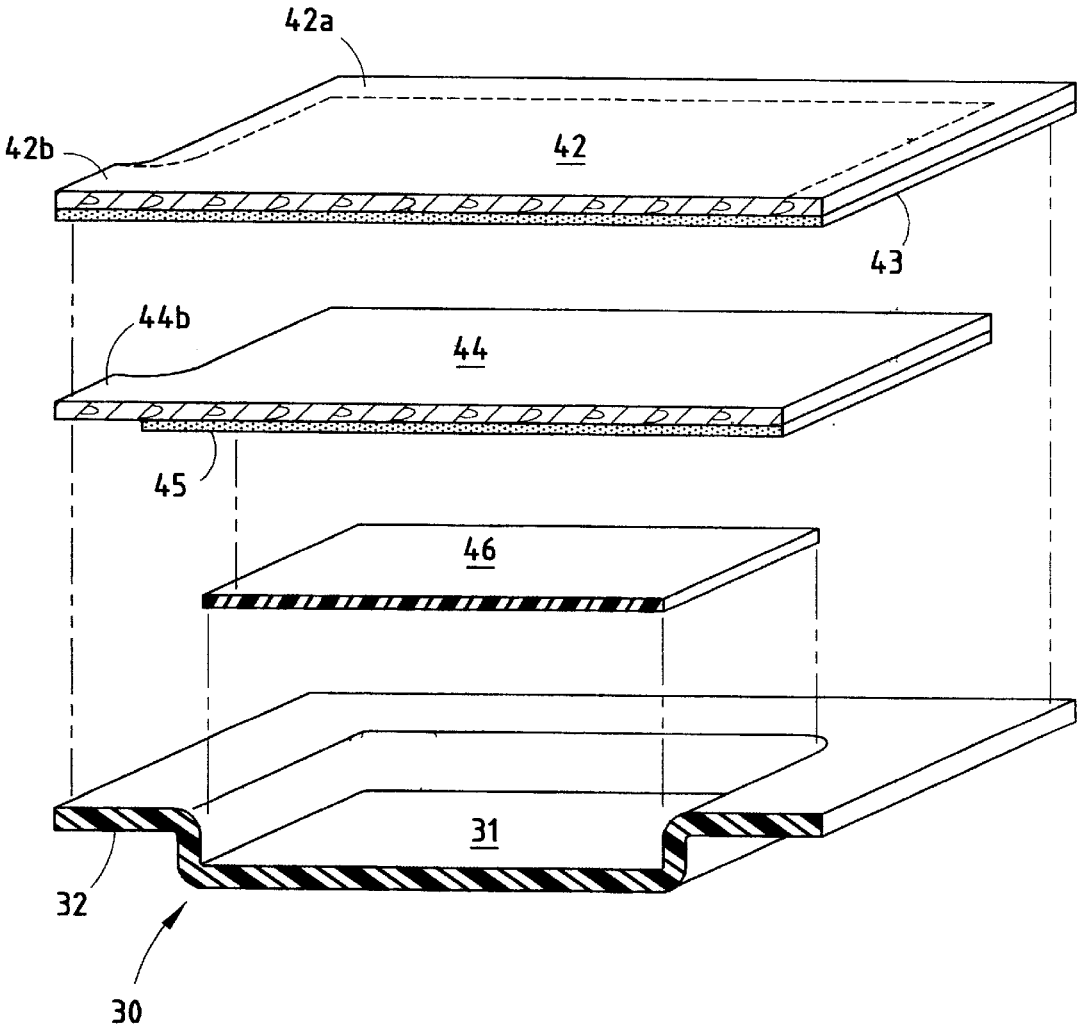
FIG. 8 is a cross-sectional perspective view of the embodiment in which both the releasable, resealable adhesive and the permanent adhesive are adhered to a flange at the top of the container.

FIG. 8 is a cross-sectional, perspective view of yet another alternative embodiment in which no display card 28 is utilized. Container 30 is preferably vacuum-formed of a plastic such as PVC to include a recess or well 31 and a top perimeter flange 32. As with the covers described above, the cover for container 30 is a composite of three layers of material, 42, 44 and 46. Layer 42, like cover layer 12, is preferably a film of flexible material, such as coated paper, relatively thin cardboard, or a plastic material, most preferably a coated paper. It includes a perforation near its perimeter to create a separable portion 42*a,* which is comparable to separable portion 12*a* of cover layer 12. Also as with cover layer 12, the undersurface of layer 42 is entirely covered with a permanent adhesive 43.

Adhered to layer 42 by permanent adhesive layer 43 is layer 44, which like layer 14 is either a plastic film or, more preferably, a layer of coated paper. As with layer 14 in FIG. 1, layer 44 covers the entire undersurface of layer 42, except for the tamper evident portion 42*a* thereof. Layer 44 also includes a tab portion 44*b* which underlies tab portion 42*b*. Layer 44 is entirely coated on its undersurface by a releasable, resealable adhesive layer 45, except that releasable resealable adhesive layer 45 does not extend into tab portion 44*b*. The composite tab 42*b*, 44*b* thus provides a tab which can be used to lift the composite cover from container 30.

Layer 46 is comparable to layer 16, and is configured to overlie only the opening portion of container 30. In this way, it prevents the contents of container 30 from adhering to the adhesive layer 45 which underlies material layer 44.

In use, the composite cover 42, 44, 46 is adhered to the upper flange or rim 32 of container 30, with product located in recess or well 31. To access the contents of the container, one lifts the cover at tab 42*b*–44*b*, and peels the cover back, thus causing the cover to separate from portion 42*a* which is permanently adhered to flange 32 of container 30. Container 30 can then be resealed by simply pressing the separated portion of the cover back down onto flange 32, with the releasable, resealable, adhesive layer 45 adhering to perimeter flange 32.

The solutions offered by the invention herein have thus been attained in an economical, practical, and facile manner. While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

The invention claimed is:

1. A package comprising:

a container having an opening therein, which opens into an interior cavity;

said container having a perimeter adjacent surface located adjacent the perimeter of said opening;

a cover adhered to a portion of said perimeter adjacent surface of said container by a releasable, resealable adhesive;

said cover including a tamper indicator, extending beyond said perimeter adjacent surface, that is separable from the rest of said cover; and a substrate surface, extending beyond said perimeter adjacent surface, said tamper indicator being adhered to said substrate surface by a permanent adhesive.

2. The package of claim 1, wherein the container further comprises a flange, which projects away from said container opening and defines said perimeter adjacent surface;

said substrate surface being defined by a substrate member, which is separate from said container;

said substrate member, including an opening through which said container projects, with said container flange resting against said substrate member; whereby until said tamper indicator is separated from the rest of said cover, when said flange is trapped between said cover and said substrate by said tamper indicator being permanently adhered to said substrate surface, the substrate traps the flange of the container between the cover and the substrate.

3. The package of claim 2, in which said container flange is not adhered to said substrate member, such that when said cover on said container is opened for the first time, such that said tamper indicator is thereby separated from said cover, said container can be removed from said substrate member and used with said cover, less said separated tamper indicator, as a resealable container.

4. The package of claim 2, wherein the container includes a pull tab extending from the flange of the container and wherein the substrate further includes a notch thereby facilitating access to the pull tab of said container.

5. The package of claim 1 comprising:

said cover comprising a composite of first and second layers, each having a perimeter and an undersurface;

said first layer having said permanent adhesive applied at least about a portion of said first layer undersurface adjacent said first layer perimeter;

said second layer having a said releasable, resealable adhesive applied at least about a portion of said second layer undersurface adjacent said second layer perimeter;

said second layer being of lesser area than said first layer, such that a portion of said first layer extends beyond said perimeter of said second layer, to define said tamper indicator portion of said cover; and said permanent adhesive extending away from said perimeter of said first layer a distance sufficient to engage and adhere said second layer to said first layer.

6. The package of claim 5, wherein said permanent adhesive substantially covers said undersurface of said first layer.

7. The package of claim 6, in which said adhesive coated second layer is substantially covered with said releasable, resealable adhesive, said cover further comprising a covering film layer adhered by said releasable, resealable adhesive to said second layer, said covering layer being of an area approximately equivalent to the area of said opening of said container, thereby preventing the releasable, resealable adhesive from engaging items to be contained in said container.

8. The package of claim 7, wherein the container further comprises a flange, which projects away from said container opening and defines said perimeter adjacent surface;

said substrate surface being defined by a substrate member, which is separate from said container;

said substrate member, including an opening through which said container projects, with said container flange resting against said substrate member; whereby until said tamper indicator is separated from the rest of said cover, when said flange is trapped between said cover and said substrate by said tamper indicator being permanently adhered to said substrate surface, the substrate traps the flange of the container between the cover and the substrate.

9. The package of claim 5, wherein the container further comprises a flange, which projects away from said container opening and defines said perimeter adjacent surface;

said substrate surface being defined by a substrate member, which is separate from said container;

said substrate member, including an opening through which said container projects, with said container flange resting against said substrate member; whereby until said tamper indicator is separated from the rest of said cover, when said flange is trapped between said cover and said substrate by said tamper indicator being permanently adhered to said substrate surface, the substrate traps the flange of the container between the cover and the substrate.

10. The resealable tamper evident container of claim 9, wherein the visual display article is engaged to the container.

11. The package of claim 5, wherein said cover further comprises a perforation, which defines the boundary between said tamper indicator and the rest of said cover, and facilitates the separation of the rest of the cover from the tamper indicator.

12. The resealable tamper evident container of claim 1 further comprising a visual display article spaced within said interior cavity.

13. The resealable tamper evident container of claim 1, wherein the container is plastic.

14. The package of claim 1, wherein said cover further comprises a perforation, which defines the boundary between said tamper indicator and the rest of said cover, and facilitates the separation of the rest of the cover from the tamper indicator.

15. The package of claim 1 wherein said substrate surface, extending beyond said perimeter adjacent surface, comprises a continuation of said perimeter adjacent surface.

16. The package of claim 15, in which said substrate surface and said perimeter adjacent surface comprising the surface of a perimeter flange projecting away from and surrounding said container opening.

17. The package of claim 16 comprising:

said cover comprising a composite of first and second layers, each having a perimeter and an undersurface;

said first layer having said permanent adhesive applied at least about a portion of said first layer undersurface adjacent said first layer perimeter;

said second layer having a said releasable, resealable adhesive applied at least about a portion of said second layer undersurface adjacent said second layer perimeter;

said second layer being of lesser area than said first layer, such that a portion of said first layer extends beyond said perimeter of said second layer, to define said tamper indicator portion of said cover; and said permanent adhesive extending away from said perimeter of said first layer a distance sufficient to engage and adhere said second layer to said first layer.

18. The package of claim 17, wherein said permanent adhesive substantially covers said undersurface of said first layer.

19. The package of claim 18, in which said adhesive coated second layer is substantially covered with said releasable, resealable adhesive, said cover further comprising a covering film layer adhered by said releasable, resealable adhesive to said second layer, said covering layer being of an area approximately equivalent to the area of said opening of said container, thereby preventing the releasable, resealable adhesive from engaging items to be contained in said container.

20. The package of claim 15 comprising:

said cover comprising a composite of first and second layers, each having a perimeter and an undersurface;

said first layer having said permanent adhesive applied at least about a portion of said first layer undersurface adjacent said first layer perimeter;

said second layer having a said releasable, resealable adhesive applied at least about a portion of said second layer undersurface adjacent said second layer perimeter;

said second layer being of lesser area than said first layer, such that a portion of said first layer extends beyond said perimeter of said second layer, to define said tamper indicator portion of said cover; and said permanent adhesive extending away from said perimeter of said first layer a distance sufficient to engage and adhere said second layer to said first layer.

21. The package of claim 20, wherein said permanent adhesive substantially covers said undersurface of said first layer.

22. The package of claim 21, in which said adhesive coated second layer is substantially covered with said releasable, resealable adhesive, said cover further comprising a covering film layer adhered by said releasable, resealable adhesive to said second layer, said covering layer being of an area approximately equivalent to the area of said opening of said container, thereby preventing the releasable, resealable adhesive from engaging items to be contained in said container.

23. The method of manufacturing and using a tamper evident reusable package comprising:

providing a cover comprising a first layer wherein at least a portion of its perimeter is perforated, a second layer, a container having a flange, and a substrate;

applying a permanent adhesive to the first layer;

applying a releasable, resealable adhesive to a second layer;

engaging the first and second layers such that the perforated perimeter having the permanent adhesive and the releasable, resealable adhesive of the second layer are exposed;

engaging the container with at least the second layer; and engaging the first layer to the substrate using the permanent adhesive, thereby trapping the flange of said container between the cover and the substrate.

24. A resealable container comprising:

a container having an opening into an interior cavity of said opening;

said container having a perimeter adjacent surface located adjacent the perimeter of said opening;

a cover having an undersurface substantially covered with a releasable, resealable adhesive; said cover being releasably, resealably adhered by said adhesive to said perimeter adjacent surface of said container;

a film layer adhered by said releasable, resealable adhesive to and covering a portion of said undersurface of said cover said film layer being generally coextensive with said container opening, wherein said film layer eliminates the need to apply adhesive to only a portion of said undersurface of said cover in order to keep the contents of said container from being exposed to a substantial amount of said releasable, resealable adhesive; and a substrate wherein said perimeter adjacent surface of said container rests against said substrate whereby said perimeter adjacent surface is trapped between said cover and said substrate.

25. A package comprising:

a container having an opening therein, which opens into an interior cavity;

said opening having a perimeter;

said container having a perimeter adjacent surface located adjacent the perimeter;

a cover overlying said opening and including an inner perimeter portion which overlies and is adhered to the entire portion of said perimeter adjacent surface of said container by a releasable, resealable container; and said cover including an outer perimeter portion, which is separable from the rest of said cover, and which overlies and is adhered by a permanent adhesive to a substrate surface, which surrounds and extends beyond said perimeter adjacent surface, whereby said cover is held in place against accidental removal during display, storage, and the like, but can be intentionally removed and subsequently resealed by separating said cover from said outer perimeter portion.

26. The package of claim 25, wherein a perforation line separates said outer perimeter portion of said cover from said inner perimeter portion, which facilitates separation.

27. The package of claim 26, wherein the container further comprises a flange, which projects away from said container opening and defines said perimeter adjacent surface;

said substrate surface being defined by a substrate member, which is separate from said container;

said substrate member, including an opening through which said container projects, with said container flange resting against said substrate member; whereby until said outer perimeter portion is separated from the rest of said cover, when said flange is trapped between said cover and said substrate by said outer perimeter portion being permanently adhered to said substrate surface, the substrate traps the flange of the container between the cover and the substrate.

28. The package of claim 27, in which said container flange is not adhered to said substrate member, such that when said cover on said container is opened for the first time, such that said outer perimeter portion is thereby separated from said cover, said container can be removed from said substrate member and used with said cover, less said separated outer perimeter portion, as a resealable container.

29. The package of claim 25, wherein the container further comprises a flange, which projects away from said container opening and defines said perimeter adjacent surface;

said substrate surface being defined by a substrate member, which is separate from said container;

said substrate member, including an opening through which said container projects, with said container flange resting against said substrate member; whereby until said outer perimeter portion is separated from the rest of said cover, when said flange is trapped between said cover and said substrate by said outer perimeter portion being permanently adhered to said substrate surface, the substrate traps the flange of the container between the cover and the substrate.

30. The package of claim 29, in which said container flange is not adhered to said substrate member, such that when said cover on said container is opened for the first time, such that said outer perimeter portion is thereby separated from said cover, said container can be removed from said substrate member and used with said cover, less said separated outer perimeter portion, as a resealable container.

* * * * *

UNITED STATES PATENT AND TRADEMARK OFFICE

CERTIFICATE OF CORRECTION

PATENT NO. : 6,364,113 B1
DATED : April 2, 2002
INVENTOR(S) : Adrian L. Faasse, Jr. et al.

It is certified that error appears in the above-identified patent and that said Letters Patent is hereby corrected as shown below:

Column 9,
Line 2, replace “resealable container” with -- resealable adhesive --.

Signed and Sealed this

Twenty-second Day of July, 2003

JAMES E. ROGAN
*Director of the United States Patent and Trademark Office*